US005820343A

United States Patent [19]

Kraft et al.

[11] Patent Number: 5,820,343

[45] Date of Patent: Oct. 13, 1998

[54] AIRFOIL VIBRATION DAMPING DEVICE

[75] Inventors: Robert J. Kraft; Robert J. McClelland, both of Palm City, Fla.

[73] Assignee: United Technologies Corporation, Hartford, Conn.

[21] Appl. No.: 509,259

[22] Filed: Jul. 31, 1995

[51] Int. Cl.[6] ..... F01D 5/26

[52] U.S. Cl. ..... 416/96 A; 416/248; 416/500

[58] Field of Search ..... 416/96 A, 248, 416/500

[56] References Cited

U.S. PATENT DOCUMENTS

| | | | |
|---|---|---|---|
| 2,460,351 | 2/1949 | Hoffman et al. | 170/159 |
| 2,828,941 | 4/1958 | Foley | 253/77 |
| 3,973,874 | 8/1976 | Corsmeier et al. | 416/97 A |
| 4,162,136 | 7/1979 | Parkes | 416/96 A |
| 4,188,171 | 2/1980 | Baskin | 416/226 |
| 4,329,119 | 5/1982 | Baskin | 416/226 |
| 4,437,810 | 3/1984 | Pearce | 416/96 A |
| 4,441,859 | 4/1984 | Sadler | 416/96 A |
| 4,484,859 | 11/1984 | Pask et al. | 416/96 A |
| 4,526,512 | 7/1985 | Hook | 416/96 A |
| 5,165,860 | 11/1992 | Stoner et al. | 416/500 |
| 5,232,344 | 8/1993 | El-Aini | 416/500 |
| 5,407,321 | 4/1995 | Rimkunas et al. | 416/500 |

FOREIGN PATENT DOCUMENTS

| | | | |
|---|---|---|---|
| 492320 | 4/1953 | Canada | 416/500 |
| 535074 | 12/1956 | Canada | 416/500 |
| 582411 | 9/1959 | Canada | 416/500 |
| 891635 | 3/1944 | France | 416/500 |
| 1024218 | 3/1953 | France | 416/500 |
| 549581 | 5/1977 | Russian Federation | 416/145 |
| 347964 | 5/1931 | United Kingdom | 416/500 |

*Primary Examiner*—Edward K. Look
*Attorney, Agent, or Firm*—Richard D. Getz

[57] ABSTRACT

A rotor blade for a rotor assembly is provided which includes a root, an airfoil, a platform, and a damper. The airfoil includes at least one cavity. The platform extends laterally outward from the blade between the root and the airfoil, and includes an airfoil side, a root side, and an aperture extending between the root side of the platform and the cavity within the airfoil. The damper, which includes at least one bearing surface, is received within the aperture and the cavity. The bearing surface is in contact with a surface within the cavity and friction between the bearing surface and the surface within the cavity damps vibration of the blade.

12 Claims, 4 Drawing Sheets

AIRFOIL VIBRATION DAMPING DEVICE

The invention was made under a U.S. Government contract and the Government has rights herein.

BACKGROUND OF THE INVENTION

1. Technical Field

This invention applies to rotor blades in general, and to apparatus for damping vibration within a rotor blade in particular.

2. Background Information

Turbine and compressor sections within an axial flow turbine engine generally include a rotor assembly comprising a rotating disc and a plurality of rotor blades circumferentially disposed around the disk. Each rotor blade includes a root, an airfoil, and a platform positioned in the transition area between the root and the airfoil. The roots of the blades are received in complementary shaped recesses within the disk. The platforms of the blades extend laterally outward and collectively form a flow path for fluid passing through the rotor stage. The forward edge of each blade is generally referred to as the leading edge and the aft edge as the trailing edge. Forward is defined as being upstream of aft in the gas flow through the engine.

During operation, blades may be excited into vibration by a number of different forcing functions. Variations in gas temperature, pressure, and/or density, for example, can excite vibrations throughout the rotor assembly, especially within the blade airfoils. Gas exiting upstream turbine and/or compressor sections in a periodic, or "pulsating", manner can also excite undesirable vibrations. Left unchecked, vibration can cause blades to fatigue prematurely and consequently decrease the life cycle of the blades.

Blades can be damped to avoid vibration. For example, it is known that frictional dampers may be attached to an external surface of the airfoil, or inserted internally through the airfoil inlet area. A disadvantage of adding a frictional damper to an external surface is that the damper is exposed to the harsh, corrosive environment within the engine. As soon as the damper begins to corrode, its effectiveness is compromised. In addition, if the damper separates from the airfoil because of corrosion, the damper could cause foreign object damage downstream. It is also known to enclose a damper within an external surface pocket and thereby protect the damper from the harsh environment. In most cases, however, the damper must be biased between the pocket and the pocket lid and the effectiveness of the damper will decrease as the damper frictionally wears within the pocket.

Inserting a damper up through the airfoil inlet conduits disposed in the blade root, another common damping approach, also has drawbacks. A damper inserted up through the airfoil inlet must be flexible enough to avoid cooling passages within the inlet and the airfoil. In instances where damping is necesssary near the leading and/or trailing edges, the damper must be flexible enough to curve out toward the edge and then back along the edge. Flexibility, however, is generally inversely related to spring rate. Increasing the flexibility of a spring decreases the strength of the spring, and therefore the effectiveness of the damper. Dampers inserted within the airfoil inlet also decrease the cross-sectional area through which cooling air may enter the blade.

In short, what is needed is a rotor blade having a vibration damping device which is effective in damping vibrations within the blade, which is easily installed and removed, and which minimizes does not compromise cooling within the blade.

DISCLOSURE OF THE INVENTION

It is, therefore, an object of the present invention to provide a rotor blade for a rotor assembly that includes means for effectively damping vibration within that blade.

It is another object of the present invention to provide means for damping vibrations in a rotor blade which may be easily installed and removed.

It is still another object of the present invention to provide means for damping vibration in a rotor blade that does not inhibit the flow of cooling air within the blade.

It is still another object of the present invention to provide a means for damping vibration within a rotor blade that facilitates cooling of the blade.

According to the present invention, a rotor blade for a rotor assembly is provided which includes a root, an airfoil, a platform, and a damper. The airfoil includes at least one cavity. The platform extends laterally outward from the blade between the root and the airfoil, and includes an airfoil side, a root side, and an aperture extending between the root side of the platform and the cavity within the airfoil. The damper is received within the aperture and the cavity. Friction between the damper and a surface within the airfoil damps vibration of the blade.

An advantage of the present invention is that a stiffer damper may be used because the damper is inserted into the airfoil from the root side of the platform. The stiffness of many prior art internal dampers is often limited by the path through which the damper must be inserted. The present invention, in contrast, allows a damper to be inserted under the platform. Dampers may therefore be positioned adjacent the leading and/or the trailing edges of the airfoil without having to curve away from the airfoil inlet area and then back toward the edge.

A further advantage of the present invention is that the damper does not require any space within the airfoil inlet area. A person of skill will recognize that airfoil inlet area is limited, particularly in those blades having a number of partitions for separating flow into different cavities. In some instances, placing a damper in this area forces partition configuration to be less than optimum. Hence, it is an advantage to either eliminate the space necessary for dampers, or minimize it by moving some of the damping function elsewhere.

A still further advantage of the present invention is that access to the damper is improved thereby facilitating removal and replacement of the damper.

A still further advantage of the present invention is that the damper may include means for facilitating cooling within the airfoil.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
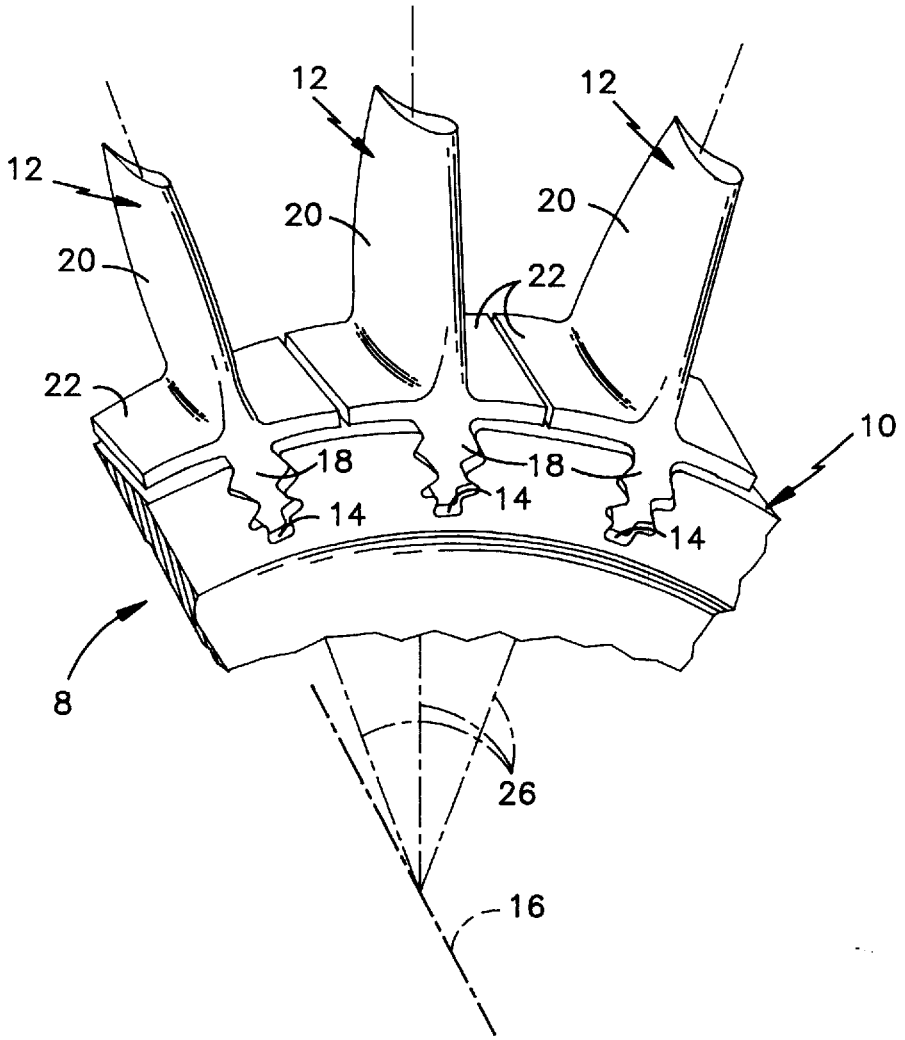
FIG. 1 is a partial perspective view of a rotor assembly.
Figure 5:
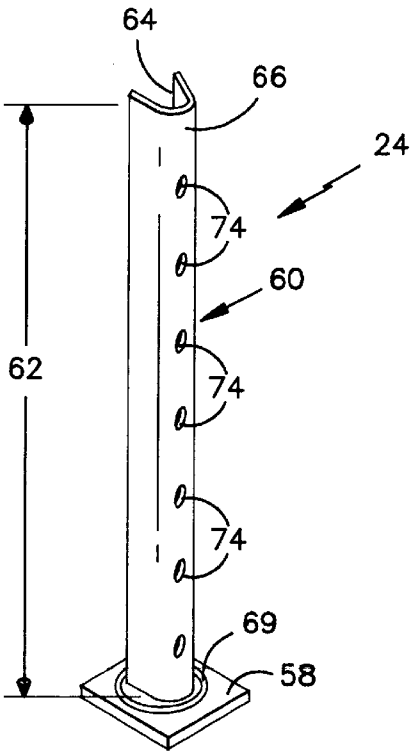
FIG. 5 is a damper having a plurality of apertures.
Figure 4:
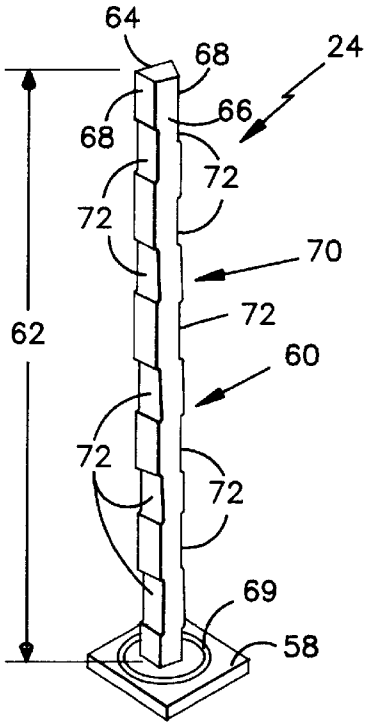
FIG. 4 is a damper having a plurality of channels.
Figure 2:
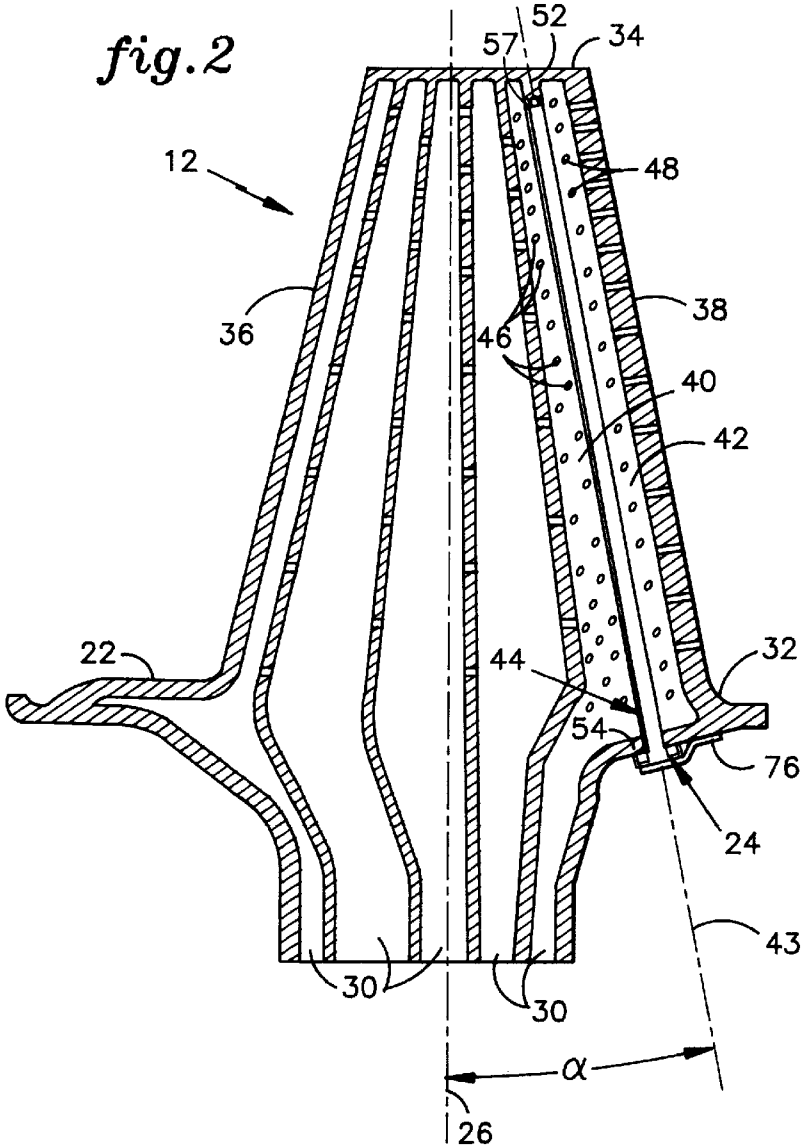
FIG. 2 is a cross-sectional view of a rotor blade.

Referring to FIG. 1, a rotor blade assembly 8 for a gas turbine engine is provided having a disk 10 and a plurality of rotor blades 12. The disk 10 includes a plurality of recesses 14 circumferentially disposed around the disk 10 and a rotational centerline 16 about which the disk 10 may rotate. Each blade includes a root 18, an airfoil 20, a platform 22, and a damper 24 (see FIG. 2). Each blade 12 also includes a radial centerline 26 passing through the blade 12, perpendicular to the rotational centerline 16 of the disk 10. The root 18 includes a geometry that mates with that of one of the recesses 14 within the disk 10. A fir tree configuration is commonly known and may be used in this instance. As can be seen in FIG. 2, the root 18 further includes conduits 30 through which cooling air may enter the root 18 and pass through into the airfoil 20.

Referring to FIG. 2, The airfoil 20 includes a base 32, a tip 34, a leading edge 36, a trailing edge 38, a first cavity 40, a second cavity 42, and a passage 44 between the first 40 and second 42 cavities. The airfoil 20 tapers inward from the base 32 to the tip 34; i.e., the length of a chord drawn at the base 32 is greater than the length of a chord drawn at the tip 34. The first cavity 40 is forward of the second cavity 42 and the second cavity 42 is adjacent the trailing edge 38. The airfoil 20 may include more than two cavities, such as those shown in FIG. 2 positioned forward of the first cavity 40. The first cavity 40 includes a plurality of apertures 46 extending through the walls of the airfoil 20 for the conveyance of cooling air. The second cavity 42 contains a plurality of apertures 48 disposed along the trailing edge 38 for the conveyance of cooling air.

Referring to FIGS. 2 and 3A–3D, in the preferred embodiment the passage 44 between the first 40 and second 42 cavities comprises a pair of walls 50 extending substantially from base 32 to tip 34. One or both walls 50 converge toward the other wall 50 in the direction from the first cavity 40 to the second cavity 42. The centerline 43 of passage 44 is skewed from the radial centerline 26 of the blade 12 such that the tip end 52 of the passage 44 is closer to the radial centerline 26 than the base end 54 of the passage 44. A pair of tabs 56 (see FIGS. 3A–3D) may be included in the first cavity 40, adjacent the passage 44, to maintain the damper 24 within the passage 44. The passage 44 may also include a plurality of ribs 57 at the tip end 52 of the passage 44 which act as cooling fins.

Referring to FIGS. 3A–3D, 4 and 5, the damper 24 includes a head 58 and a body 60 having a length 62, a forward face 64, an aft face 66, and a pair of bearing surfaces 68. The head 58, fixed to one end of the body 60, contains an "O"-shaped seal 69 for sealing between the head 58 and the blade 12. The body 60 may assume a variety of cross-sectional shapes including, but not limited to, the trapezoidal shape shown in FIGS. 3A and 3D, or the curved surface shape shown in FIG. 3B, or the "U"-shape shown in FIG. 3C. The bearing surfaces 68 extend between the forward face 64 and the aft face 66, and along the length 62 of the body 60. One or both of the bearing surfaces 68 converge toward the other in a manner similar to the converging walls 50 of the passage 44 between the first 40 and second 42 cavities. The similar geometries between the passage walls 50 and the bearing surfaces 68 enable the body 60 to be received within the passage 44 and to contact the walls 50 of the passage 44.

The body 60 of the damper 24 further includes openings 70 through which cooling air may flow between the first 40 and second 42 cavities. In one embodiment, the openings 70 include a plurality of channels 72 disposed in one or both of the bearing surfaces 68 (see FIGS. 3B, 3D, and 4). The channels 72 extend between the forward 64 and aft 66 faces, and are spaced along the length 62 of the body 60. In another embodiment, apertures 74 are disposed within the body 60 extending between the forward 64 and aft 66 faces, spaced along the length 62 of the body 60 (see FIGS. 3A, 3C, and 5). During assembly, the damper 24 is inserted into the passage 44 between the first 40 and second 42 cavities of the airfoil 20 through an aperture 43 extending between the root side 45 of the platform 22 and the passage 44 between the cavities 40,42. Inserting the damper 24 through the platform 22 avoids the aforementioned disadvantages associated with inserting a damper 24 through the airfoil inlet conduits 30 disposed in the root 18 of the blade 12. A clip 76 is provided to maintain the damper 24 within the blade 12 when the rotor assembly 8 is stationary.

Referring to FIGS. 1 and 2, under steady-state operating conditions, a rotor assembly 8 within a gas turbine engine rotates through core gas flow passing through the engine. The high temperature core gas flow impinges on the blades 12 of the rotor assembly 8 and transfers a considerable amount of thermal energy to each blade 12, usually in a non-uniform manner. To dissipate some of the thermal energy, cooling air is passed into the conduits 30 (see FIG. 2) within the root 18 of each blade 12. From there, a portion of the cooling air passes into the first cavity 40 and into contact with the damper 24. The openings 70 (see FIGS. 3A–3D) in the damper 24 provide a path through which cooling air may pass into the second cavity 42.

Referring to FIGS. 3A–3D, the bearing surfaces 68 of the damper 24 contact the walls 50 of the passage 44. The damper 24 is forced into contact with the passage walls 50 by a pressure difference between the first 40 and second 42 cavities. The higher gas pressure within the first cavity 40 provides a normal force acting against the damper 24 in the direction of walls 50 of the passage 44. Centrifugal forces, created as the disk 10 of the rotor assembly 8 is rotated about its rotational centerline 16 (see FIG. 1), also act on the damper 24. The skew of the passage 44 relative to the radial centerline 26 of the blade 12, and the damper 24 received within the passage 44, causes a component of the centrifugal force acting on the damper 24 to act in the direction of the passage walls 50; i.e., the centrifugal force component acts as an additional normal force against the damper 24 in the direction of the passage walls 50 (see also FIG. 2).

Figure 3A:
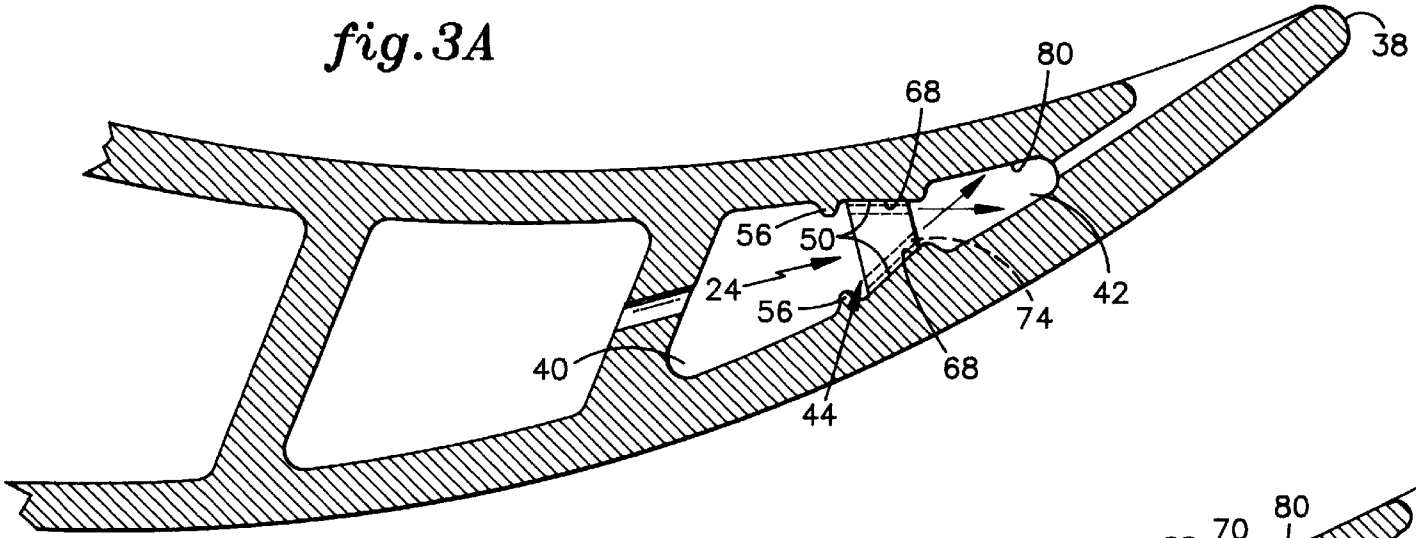
FIGS. 3A–3D are diagrammatic cross-sectional views of a rotor blade section.
Figure 3B:
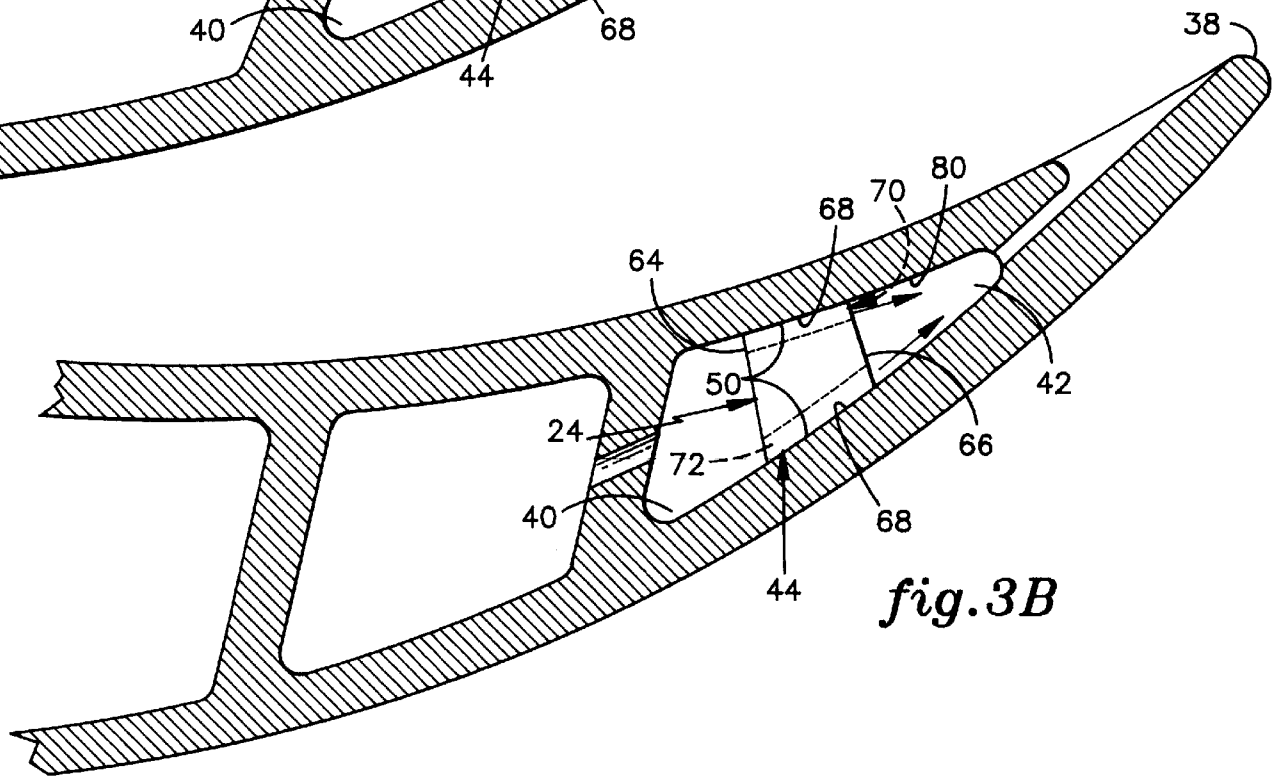
Figure 3C:
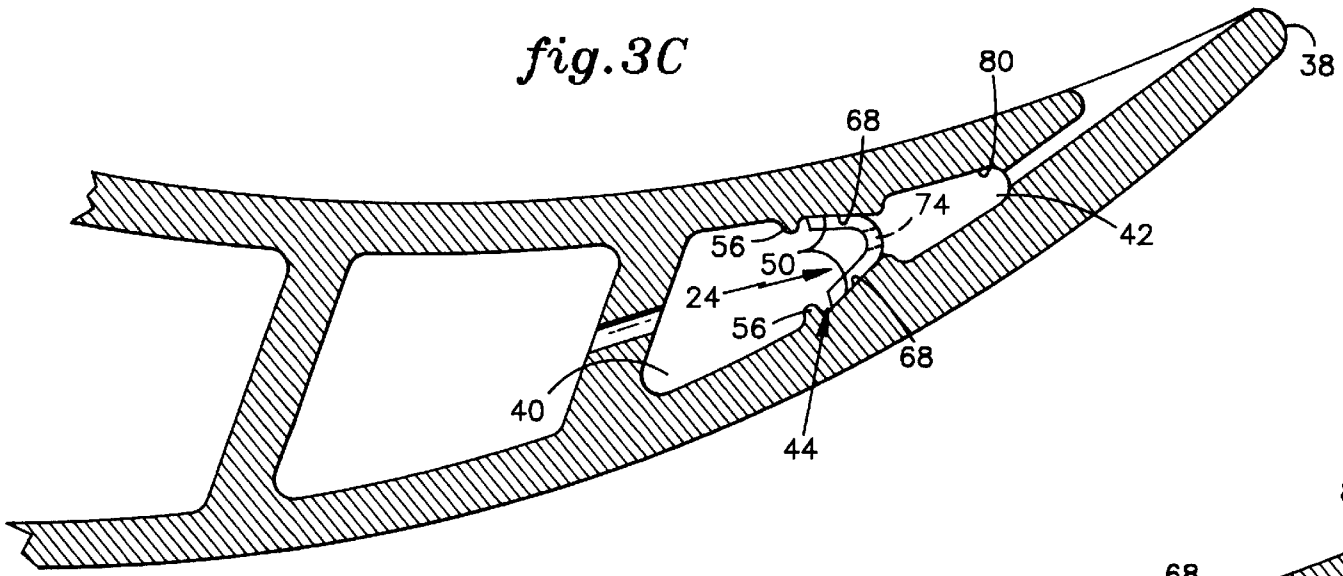
Figure 3D:
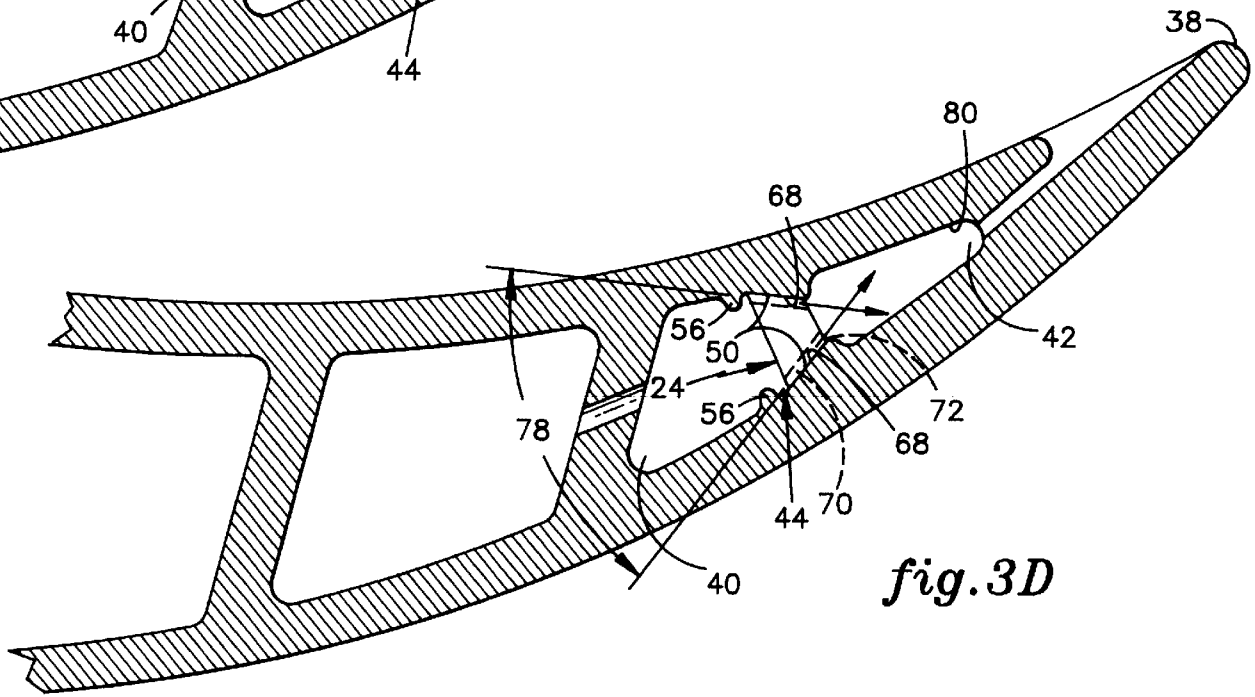

The openings 70 within the damper 24 through which cooling air may pass between the first 40 and second 42 cavities may be oriented in a variety of ways. The geometry and position of an opening(s) 70 chosen for a particular application depends on the type of cooling desired. FIG. 3B, for example, shows a damper 24 having bearing surfaces with a curvature similar to that of the passage walls 50 between the cavities 40,42. Channels 72 disposed within the curved bearing surfaces 68 direct cooling air directly along the walls 50, thereby convectively cooling the walls 50. Alternatively, if the angle of convergence 78 of the passage walls 50 and the damper bearing surfaces 68 is great enough, cooling air directed along the passage walls 50 can impinge the walls 80 of the second cavity 42 as is shown in FIG. 3D. Apertures 74 disposed in the damper 24 can also be oriented to direct air either along the walls 80 of the second cavity 42, or into the center of the second cavity 42, or to impinge on the walls 80 of the second cavity 42. FIG. 3C shows a cooling air path directly into the second cavity 42. FIG. 3A shows passage walls 50 and damper bearing surfaces 68 disposed such that cooling air impinges on the walls 80 of the second cavity 42.

Although this invention has been shown and described with respect to the detailed embodiments thereof, it will be understood by those skilled in the art that various changes in form and detail thereof may be made without departing from the spirit and the scope of the invention. For example, it is disclosed as the best mode for carrying out the invention that a damper 24 is disposed between a first 40 and second 42 cavity where the second cavity 42 is adjacent the trailing edge 38 of the airfoil 20. In alternative embodiments, the damper may be disposed in a single cavity, solely for damping purposes. Furthermore, the damper 24 may also be inserted through the platform 22 and into the airfoil 20 adjacent the leading edge 36 of the airfoil.

We claim:

1. A rotor blade for a rotor assembly having a disk, comprising:

a root, for securing said blade to the disk;

an airfoil, having a base, a tip, and at least one cavity within said airfoil;

a platform, extending laterally outward from said blade between said root and said airfoil, said platform having an airfoil side and a root side, and an aperture extending between said root side of said platform and said cavity; and a damper;

wherein said damper is received within said aperture and said cavity; and wherein friction between said damper and a surface within said cavity damps vibration of said blade.

2. A rotor blade according to claim 1, wherein said airfoil further comprises a leading edge and a trailing edge, wherein said damper is received within said airfoil adjacent said trailing edge.

3. A rotor blade according to claim 1, wherein said airfoil further comprises:

a first cavity;

a second cavity, said second cavity adjacent said trailing edge; and a passage, having walls converging at a first angle from said first cavity to said second cavity, connecting said first and second cavities; and wherein said damper is received within said passage.

4. A rotor blade according to claim 3, wherein damper further comprises:

a forward face;

an aft face; and a pair of bearing surfaces, extending between said forward and aft faces;

wherein said bearing surfaces converge toward one another from said forward face to said aft face at a second angle substantially the same as said first angle of said passage walls.

5. A rotor blade according to claim 3, wherein:

the rotor assembly has an axis of rotation and said rotor blade has a radial centerline; and said passage is skewed from said radial centerline of said blade, such that the distance between said passage and said radial centerline is greater at said airfoil base than at said airfoil tip;

wherein rotating the rotor assembly about said axis of rotation centrifugally forces said damper radially outward and into contact with said converging passage walls.

6. A rotor blade according to claim 4, wherein:

the rotor assembly has an axis of rotation and said rotor blade has a radial centerline; and said passage is skewed from said radial centerline of said blade, such that the distance between said passage and said radial centerline is greater at said airfoil base than at said airfoil tip;

wherein rotating the rotor assembly about said axis of rotation centrifugally forces said damper bearing surfaces radially outward and into contact with said converging passage walls.

7. A rotor blade according to claim 6, wherein said damper includes means for passage of gas from said first cavity to said second cavity.

8. A rotor blade according to claim 7, wherein said means for passage of gas includes a plurality of apertures.

9. A rotor blade according to claim 7, wherein said means for passage of gas includes a plurality of channels disposed within said bearing surfaces.

10. A rotor blade according to claim 4, wherein said damper includes means for passage of gas from said first cavity to said second cavity.

11. A rotor blade according to claim 3, wherein said airfoil includes a plurality of tabs extending into said first cavity, adjacent said passage, wherein said tabs prevent said damper from moving into said first cavity from said passage.

12. A rotor blade for a rotor assembly, comprising:

a root;

an airfoil, having a base, a tip, and at least one cavity within said airfoil;

a platform, extending laterally outward from said blade between said root and said airfoil, said platform having an airfoil side and a root side, and an aperture extending between said root side of said platform and said cavity; and wherein a damper may be received within said aperture and said cavity, and contact said surface within said cavity, and friction between said damper and said surface within said cavity damps vibration of said blade.

* * * * *